United States Patent [19]

Walker

[11] 4,331,921

[45] May 25, 1982

[54] TEST APPARATUS FOR TESTING INTERNAL COMBUSTION ENGINE ELECTRONIC SPARK IGNITION SYSTEMS

[75] Inventor: Michael J. Walker, Warley, England

[73] Assignee: Lucas Industries Limited, Birmingham, England

[21] Appl. No.: 151,929

[22] Filed: May 21, 1980

[30] Foreign Application Priority Data

May 25, 1979 [GB] United Kingdom ..... 7918389

[51] Int. Cl.[3] ..... F02P 17/00

[52] U.S. Cl. ..... 324/380; 324/385; 324/388

[58] Field of Search ..... 324/380, 381, 382, 385, 324/388

[56] References Cited

U.S. PATENT DOCUMENTS 3,551,800 12/1970 Widmer ..... 324/385 X 4,112,351 9/1978 Back et al. ..... 324/380

OTHER PUBLICATIONS

Ekland et al., Computer-Controlled Distributer Tester, IBM Technical Disclosure Bulletin, Jul. 1969, pp. 259 and 260.

*Primary Examiner*—Stanley T. Krawczewicz

*Attorney, Agent, or Firm*—Trexler, Bushnell & Wolters, Ltd.

[57] ABSTRACT

A test apparatus for testing electronic ignition systems includes a circuit for detecting the interruption of ignition coil primary current and triggering a 100 μS monostable. A coil current detector detects when coil current flow is recommenced and the signals from this detector and the monostable are combined via a gate to indicate satisfactory operation if the detector detects current re-commencement within 100 μS of the previous current interruption.

7 Claims, 3 Drawing Figures

TEST APPARATUS FOR TESTING INTERNAL COMBUSTION ENGINE ELECTRONIC SPARK IGNITION SYSTEMS

This invention relates to test apparatus for testing internal combustion engine electronic spark ignition systems of the kind including a step up coil having a secondary winding connected in a spark circuit and a primary winding connected in series with electronic switch means across a power supply, said switch means periodically being conductive to permit primary current to build up and then being turned off to interrupt such primary current.

The object of the present invention is to provide a simple and efficacious test apparatus for detecting faults in such an ignition system.

A test apparatus in accordance with the invention comprises first means for detecting the instant of interruption of primary current, second means for detecting the commencement of current flow through the primary winding and means receiving inputs from both said first means and said second means and producing an output pulse indicating a satisfactory operation of the system if said second means does not detect commencement of current flow within a predetermined time after said first means detects interruption of primary current.

An example of the invention is shown in the accompanying drawings in which.

Figure 1:
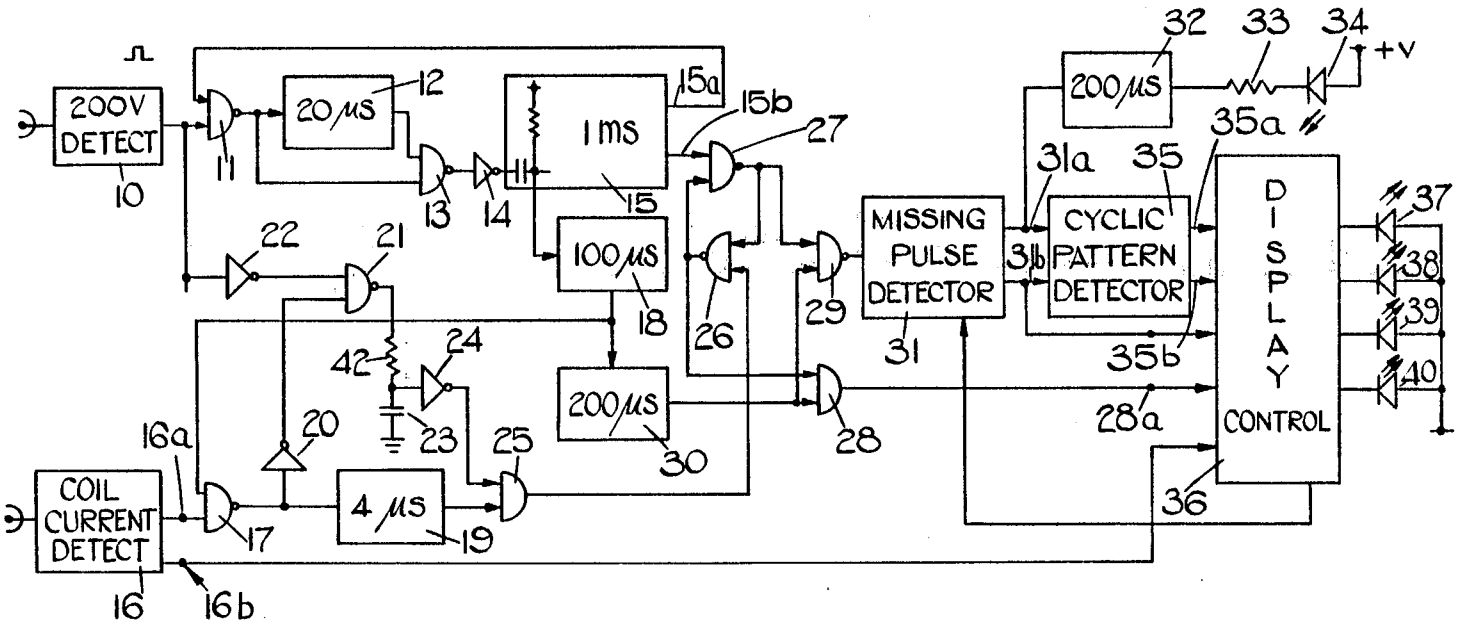
FIG. 1 is a schematic diagram of the test apparatus.

Referring firstly to FIG. 1, the apparatus includes a circuit for detecting when a spark has been created by detecting a voltage spike which remains over 200 V for less than 20 μS. The details of the circuit for this purpose are disclosed in copending application Ser. No. 152,122 of even date (based on U.K. Patent Application No. 7918386). As shown in FIG. 1, however, this circuit includes a detector 10 which produces a positive going output signal for as long as its input is at more than 200 V. The output of detector 10 is applied to one input of a NAND gate 11 the output of which is applied to the input of a monostable circuit 12 which is triggered by a negative going edge at its input and then produces a high output for the following 20 μS. The outputs of gate 11 and circuit 12 are applied to two inputs of a NAND gate 13. This gate 13 produces a low output only if the output of detector 10 goes low again before the output of circuit 12 goes low after 20 μS. The output of gate 13 is applied via an inverter 14 to a monostable circuit 15 which is negative edge triggered and has one output 15*a* which goes low for 1 mS following triggering and another output 15*b* which goes high for the same period. The output 15*a* is connected to the other input of gate 11 so as to block this gate for 1 mS following recognition of a spike.

For sensing the re-initiation of current flow in the primary winding there is a current detector circuit 16 which produces a high output at a terminal 16*a* whenever the current is in excess of a threshold value. Circuit 16 also has a terminal 16*b* at which there is a high output in the event of a supply fault as will be hereinafter explained.

Terminal 16*a* is connected to one input of a NAND gate 17 the other input of which is connected to the output of a further monostable circuit 18 triggered by the same input as circuit 15 and producing a high output for 100 μS after triggering. The output of gate 17 is connected to the input of a monostable circuit 19 which is negative going edge triggered and produces a low output for 4 μS following triggering. The output of the gate 17 is also connected via an inverter 20 to one input of a NAND gate 21, the other input of which is connected via an inverter 22 to the output of detector 10. The output of gate 21 is connected by a resistor 42 and a capacitor 23 in series to earth and the junction of the resistor 42 and capacitor 23 is connected to the input of an inverter 24. A NAND gate 25 has one input connected to the output of circuit 19 and the other to the output of inverter 24.

The output of gate 25 is normally high, but goes low if the output at terminal 16*a* goes low for more than 4 μS whilst the output of circuit 18 is high. The monostable circuit 19 prevents spurious operation of the gate 25 by noise and also delays the output of gate 25 in the event that the output of circuit 16*a* is already low when the 100 μS pulse from circuit 18 commences. This prevents pulse coincidence problems at other points in the circuit.

The output of gate 25 is connected to one input of a NAND gate 26, the other input of which is connected to the output of a NAND gate 27 which has one input connected to terminal 15*b* and the other to output of gate 26. The outputs of gates 26 and 27 are connected to two NAND gates 28, 29 respectively, each having its other input connected to the output of a monostable circuit 30 connected to be triggered by negative-going edges of the output of circuit 18 and providing a high output for 200 μS following triggering.

Gates 26 and 27 act as a latch enabled by the 1 mS output of circuit 15 and set (if at all) by the output of gate 25. As mentioned above the output 15*b* of circuit 15 only goes high for 1 mS on recognition of a short duration high voltage spike at the input of detector 10. The 100 μS circuit 18 is started at the same time as the circuit 15 and if no output is produced by gate 25 during this 100 μS period gates 26 and 27 remain in their initial states, i.e., gate 26 producing a low output and gate 27 a high output. At the end of the 100 μS period the output of circuit 30 goes high so that the output of gate 29 goes low for 200 μS whilst the output of gate 28 remains high. In the event of gate 25 producing a low output during the 100 μS period gates 26 and 27 are both set, i.e. the output of gate 26 goes high causing the output of gate 27 to go low. When circuit 30 is triggered the output of gate 28 goes low for 200 μS, whereas the output of gate 29 remains high. This is taken to indicate a multiple spark condition.

The output of gate 29 is connected to the input terminal of a missing pulse detector circuit 31 which is described in detail in copending application Ser. No. 152,127 of even date (based on U.K. Patent Application No. 7918385). During normal steady running operation circuit the gate 29 produces a train of regularly spaced 200 μS negative-going pulses. The circuit 31 produces at one output terminal 31*a* a negative-going 200 μS pulse each time a pulse is missing from the input pulse train. This negative-going pulse is synchronised with the next pulse in the input pulse train. A second output terminal 31*b* of the circuit 31 transmits a positive going 200 μS pulse immediately following each negative going pulse of the input pulse train.

The terminal 31*a* is connected to the input terminal of a d.c. triggered monostable circuit 32 the output of which goes low for 200 mS each time the input thereto goes low. The output of circuit 32 is connected by a resistor 33 to the cathode of a light emitting diode 34 which has its anode connected to the +ve supply. The light emitting diode 34 is energised each time a missing pulse is detected.

Both outputs 31*a* and 31*b* of the missing pulse detector 31 are connected to inputs of a cyclic pulse pattern recognition circuit 35 which is described in detail in copending application Ser. No. 152,121 of even date (based on U.K. Patent Application No. 7918388). This circuit includes a cycle length selection switch and produces a negative-going output pulse at an output terminal 35*a* if the same pulse is missed in two successive cycles or a negative going output pulse at a second output terminal 35*b* if two pulses are missed within one cycle. These output pulses, if produced are synchronised with the input pulses to circuit 31 (although they may be of shorter duration).

The two outputs 35*a* and 35*b* of the circuit 35 are connected to a display control circuit 36 which also has inputs from terminal 31*b* from gate 28 and from terminal 16*b*. The circuit 36 controls four light emitting diodes 37, 38 39 and 40 and is shown in detail in FIG. 3.

Figure 2:
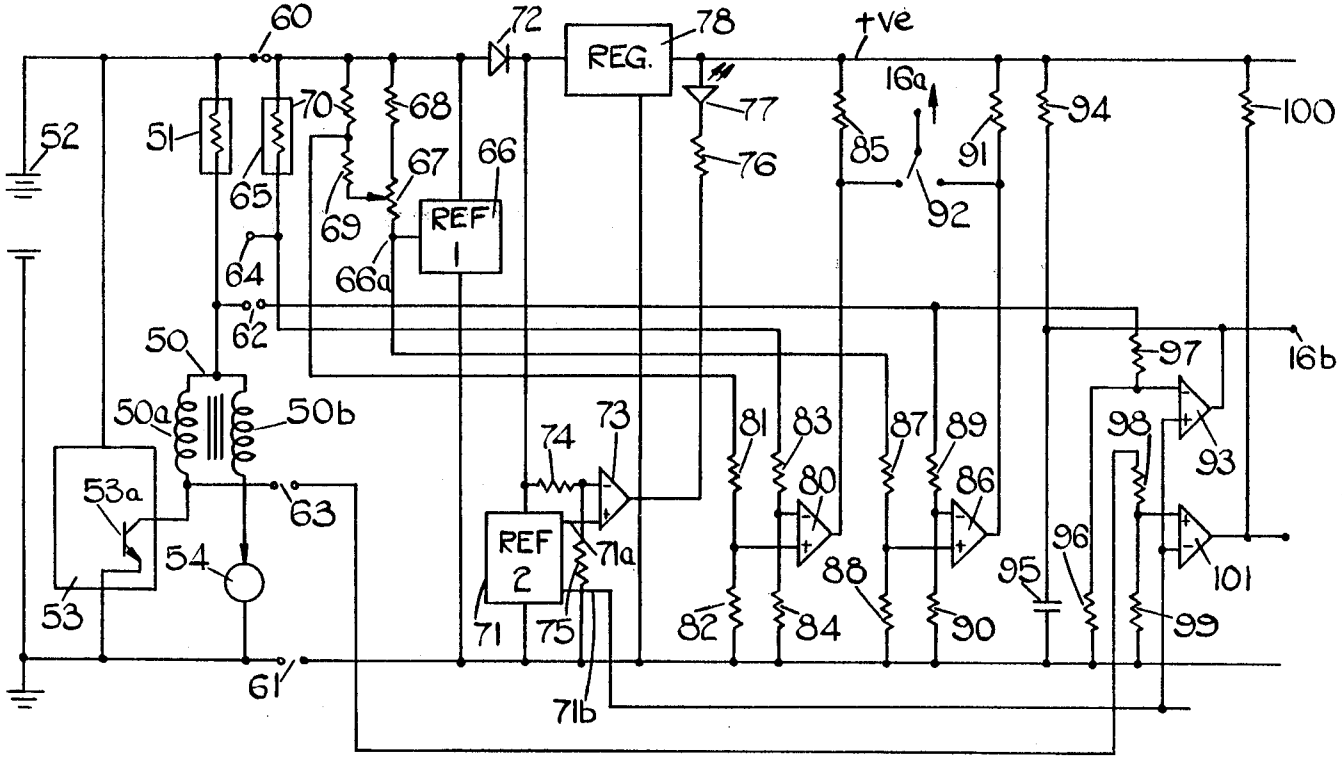
FIG. 2 is a more detailed circuit diagram of a part of the apparatus including coil current and voltage detection circuits as well as the ignition system under test.

FIG. 2 shows the input stages of the test apparatus in more detail in conjunction with an ignition system under test. As shown, the system includes a step-up coil 50 having a primary winding 50*a* and a secondary winding 50*b*. The primary winding 50*a* is connected at one end by a ballast resistor 51 to the positive terminal of a battery 52, and at the other end by the output transistor 53*a* of an electronic switching circuit 53 to earth (i.e. the negative terminal of the battery 52). The secondary winding of the coil 50 is connected between said one end of the primary winding and a spark circuit 54 having the usual earth return.

The test apparatus which forms the subject of the present invention has terminals 60 and 61 for connection to the battery positive and negative terminals and input terminals 62 and 63 for connection to said one end and said other end of the primary winding 50*a*. An additional terminal 64 is provided for use when the system to be tested does not include a ballast resistor, but uses some other means of limiting the primary current. The terminal 64 is connected by a resistor 65 to the terminal 60 and terminal 64 is used in these circumstances to supply the primary current to the coil, the normal connection between the primary winding and the battery +ve terminal being broken for this purpose.

The test apparatus includes a first reference voltage generator 66 which is connected between terminals 60 and 61 and provides an output voltage (at a terminal 66*a* which is a fixed voltage below the voltage on terminal 60). The terminal 66*a* is connected by a potentiometer 67 and a resistor 68 in series to the terminal 60 and the variable point of the potentiometer 67 is connected by two resistors 69 and 70 in series to the terminal 60.

A second reference voltage generator 71 is connected between the terminal 61 and the cathode of a protective diode 72 having its anode connected to terminal 60. The generator 71 has two output terminals 71*a* and 71*b* at different fixed voltages above the voltage at terminal 61.

A voltage comparator 73 has its non-inverting input connected to the terminal 71*a* and its inverting input connected to the common point of two resistors 74, 75 which are in series between the cathode of diode 72 and earth. The output of comparator 73 is connected by a resistor 76 to the cathode of a light emitting diode 77 the anode of which is connected to a positive supply rail connected to the output of a voltage regulator circuit 78 having its input connected to the cathode of diode 72. The light emitting diode 77 is energised whenever the battery voltage is above a predetermined minimum.

A voltage comparator 80 has its non-inverting input connected to the junction of two resistors 81, 82 which are in series between the junction of resistors 69, 70 and earth and its inverting input connected to the junction of two resistors 83, 84 connected in series between the terminal 64 and earth. The output of comparator 80 is connected by a load resistor 85 to the +ve supply rail. A further voltage comparator 86 has its non-inverting input connected to the junction of two resistors 87 and 88 which are in series between terminal 66*a* and earth, and its inverting input connected to the junction of two resistors 89 and 90 which are in series between the terminal 62 and earth. The output of the comparator 86 is connected by a load resistor 91 to the +ve rail. A selector switch 92 is connected to select which of the two comparators 80, 86 has its output connected to the output terminal 16*a* of the current detector 16*b* of which the comparators 80, 86 and the associated reference voltage generator 66 form part. The output of the selected comparator 80 or 86 goes high only when there is sufficient current flowing in the ballast resistor 51 or substitute resistor 65 to take the potential at the inverter input of that comparator below the voltage at the non-inverting input thereto.

A voltage comparator 93 also forms part of the circuit 16 and its output is connected to terminal 16*b* and also by a resistor 94 to the +ve and by a capacitor 95 to earth. The non-inverting input of comparator 93 is connected directly to terminal 71*b* and its inverting input is connected to the junction of two resistors 96 and 97 in series between the terminal 62 and earth. The output of comparator 93 is high only if the combined voltage drop across the transistor 53*a* and the primary winding 50*a* falls below a threshold level determined by the voltage at terminal 71*b* and the ratio of the resistors 95, 96. The capacitor 95 ensures that the output of comparator 93 does not go high immediately this condition occurs so as to obviate amplification of noise by the comparator 93.

The 200 V detector circuit 10 includes a voltage comparator 101 having its inverting input connected to the terminal 71*b* and its non-inverting input connected to the junction of two resistors 98, 99 in series between terminal 63 and earth. The output of comparator 101 is connected by a resistor 100 to the positive rail and its output is the signal fed to gate 11 and inverter 22 in FIG. 1.

Figure 3:
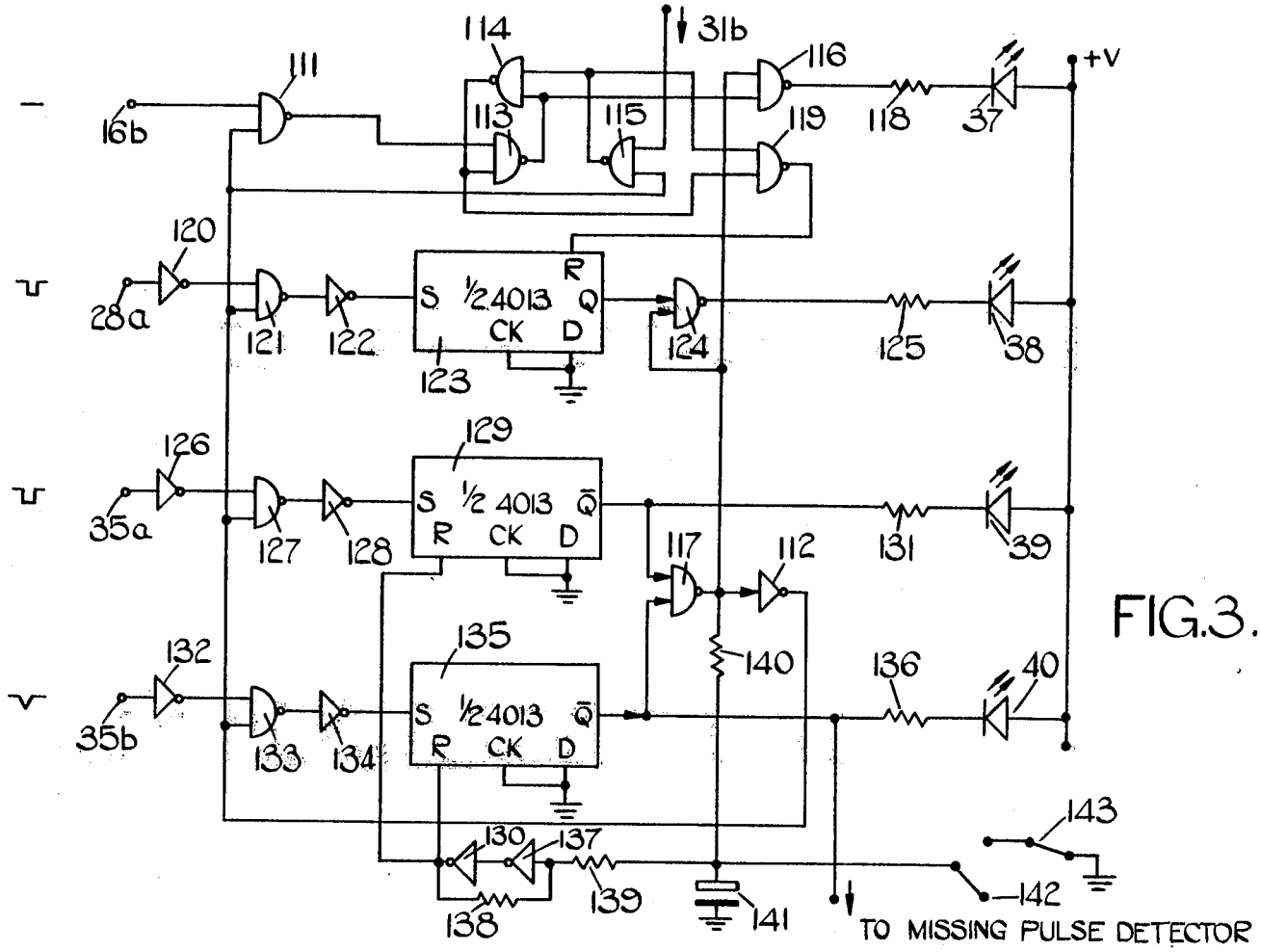
FIG. 3 is a more detailed diagram of a display control included in FIG. 1.

Turning now to FIG. 3, the terminal 16*b* is connected to one input of a NAND gate 111, the other input of which is connected to the output of an inverter 112. The output of gate 111 is connected to one input of a NAND gate 113, the other input of which is connected to the output of a NAND gate 114 and the output of which is connected to one input of gate 114. The other input of gate 114 is connected to the output of a NAND gate 115 one input of which is connected to terminal 31*b* and the other input of which is connected to the output of inverter 112. The output of gate 113 is also connected to one input of a NAND gate 116 the other input of which is connected to the output of a NAND gate 117 to which the input of inverter 112 is also connected. The output of gate 116 is connected by a resistor 118 to the cathode of light emitting diode 37. A NAND gate 119 has one input connected to the output of gate 114 and its other input connected to the output of gate 115.

The output terminal 28*a* of gate 28 (see FIG. 1) is connected via an inverter 120 to one input of a NAND gate 121 the other input of which is connected to the output of inverter 112. The output of gate 121 is connected via an inverter 122 to the SET input of a D-type flip-flop circuit 123 having its CLOCK and D inputs grounded and its RESET input connected to the output of gate 119. The Q output of circuit 123 is connected to one input of a NAND gate 124, the other input of which is connected to the output of gate 117 and the output of which is connected by a resistor 125 to the cathode of light emitting diode 38.

The terminal 35*a* of the cyclic pattern recognition circuit 35 is connected via an inverter 126 to one input of a NAND gate 127 the other input of which is connected to the output of inverter 112. The output of gate 127 is connected via an inverter 128 to the SET input of a D-type flip-flop circuit 129 having its CLOCK and D inputs grounded and its RESET input connected to the output of an inverter 130. The $\overline{Q}$ output of circuit 129 is connected by a resistor 131 to the cathode of light emitting diode 39.

The terminal 35*b* is connected via an inverter 132 to one input of a NAND gate 133 the other input of which is connected to the output of the inverter 112 and the output of which is connected via an inverter 134 to the SET input of a D-type flip-flop circuit 135 having its CLOCK and D inputs grounded and its RESET input connected to the output of inverter 130. The $\overline{Q}$ output of circuit 135 is connected by a resistor 136 to the cathode of the light emitting diode 40.

The gate 117 has its two inputs connected to the $\overline{Q}$ outputs of circuits 129 and 135.

The inverter 130 has its input connected to the output of an inverter 137, a feedback resistor 138 being connected between the output of inverter 130 and the input of inverter 137 which is connected by two resistors 139, 140 in series to the output of gate 117, a capacitor 141 connecting the junction of resistors 139, 140 to earth. This junction is also connected to a switch 142 by means of which it can be selected whether the apparatus will reset automatically after detecting a fault. In the open position shown the capacitor 141 will charge up slowly following the output of gate 140 going high, until the output of inverter 130 goes high thereby providing a resetting pulse to circuits 129 and 135. In the alternative position of switch 142 the junction of resistors 139 and 140 is connected to a reset switch 143 which in its normal position (as shown) connects this junction to earth so that charging of capacitor 141 is prevented. When actuated, switch 143 connects this junction to the +ve rail, thereby charging capacitor 141 rapidly to provide the reset pulse.

After resetting the $\overline{Q}$ outputs of circuit 129 and 135 are both high so that the output of gate 117 is low and that of inverter 112 high. Thus gates 111, 115, 121, 127 and 133 are all enabled, but gates 116 and 124 are both blocked.

In the event of a cyclically repeated missing pulse occurring, the output at terminal 35*a* goes low briefly thereby setting circuit 129 so that the $\overline{Q}$ output thereof goes low. As a result light emitting diode 39 is lit and the output of gate 117 goes high. In the auto-reset mode capacitor 141 now starts charging up. The output of inverter 112 goes low thereby blocking gates 111, 121, 127 and 133 so that no changes in the display can occur until resetting occurs.

In the event of the first fault after resetting being a multiple misfire, i.e. two missing pulses within one cycle the output of terminal 35*b* goes low briefly causing circuit 135 $\overline{Q}$ output to go low, lighting light emitting diode 40, starting the reset operation and blocking gates 111, 121, 127 and 133 as before.

The occurrence of a negative going pulse at terminal 28*a* indicates (as mentioned above) a multiple firing condition. If such a pulse occurs between resetting of circuits 129 and 135 and the first low output of terminal 35*a* and 35*b* circuit 123 will be set and its Q output will go high. Gate 124 will, however, be blocked by the low output of gate 117 and circuit 123 will be reset by the next pulse at terminal 31*b* via gates 115 and 119. If, however, a negative going pulse at terminal 28*a* coincides with one at terminal 35*b* circuits 123 and 135 will both be set (the later slightly later than the former) so that the $\overline{Q}$ output of circuit 135 goes low before the next pulse arrives at terminal 31*b*. As a result the operation of the missing pulse detector 31 is arrested gates 111, 121, 127 and 133 are blocked but gate 124 is enabled so that light emitting diode 38 is lit. Gate 115 is also blocked so that the following pulses at terminal 31*b* do not reset circuit 123 until circuit 135 has been reset.

The above paragraph is true only if the signal at terminal 16*b* is not high at the same time as the signal at terminal 28*a* is low. If this condition does occur the output of gate 111 goes low causing the output of gate 113 to go high thereby causing the output of gate 114 to go low thereby latching gates 113 and 114 until the output of gate 115 goes high, and resetting circuit 123. The output of inverter 112 goes low before the next pulse at terminal 31*b* thereby blocking gate 115. Gate 116 is enabled and light emitting diode 37 is lit instead of diode 38.

The invention is claimed as follows:

1. A test apparatus for testing internal combustion engine electronic spark ignition systems of the kind referred to, comprising first means for detecting the instant of interruption of primary current, second means for detecting the commencement of current flow through the primary winding and third means receiving inputs from both said first means and said second means and producing an output pulse indicating a satisfactory operation of the system if said second means does not detect commencement of current flow within a predetermined time after said first means detects interruption of primary current.

2. A test apparatus as claimed in claim 1 said third means further comprising a monostable circuit connected to be triggered by said first means and a first logic gate to which the outputs of said monostable circuit and said second means are applied, said monostable circuit enabling said first logic gate for the duration of said predetermined time.

3. A test apparatus as claimed in claim 2 said third means further including a second logic gate having inputs from said logic gate and said first means and acting to block the output of the first logic gate if the output of said first means fails to resume a normal state after said instant of interruption of the primary current.

4. A test apparatus as claimed in claim 3 said third means further including a further monostable circuit connected to be triggered by the output of the first logic gate, a delay circuit driven by the second logic gate and a third logic gate combining the outputs of the delay circuit and the further monostable circuit, so that said third logic gate is blocked by said further monostable circuit for a relatively short time following the re-commencement of current flow in the primary winding.

5. A test apparatus as claimed in claim 1, claim 3 or claim 4 further comprising a latch circuit coupled in circuit with said first means so as to be enabled thereby and also connected to receive said output pulse indicating satisfactory operation so as to be set thereby and a missing pulse detector circuit arranged to produce a pulse each time the interval between said output pulse is long in relation to the preceding such interval.

6. A test apparatus as claimed in claim 5 further comprising a cyclic pattern detector connected to the missing pulse detector and arranged to provide an output indicating when there are missing pulses in the same position in two successive engine cycles.

7. A test apparatus as claimed in claim 6 including a display control with input connections from the cyclic pattern detector, the missing pulse detector, said second means and a further logic gate connected to said latch circuit, and controlling a plurality of display devices indicating different types of fault according the combination of signals received thereby.

* * * * *